US008284224B2

(12) United States Patent
Takeda

(10) Patent No.: US 8,284,224 B2
(45) Date of Patent: Oct. 9, 2012

(54) THERMAL PRINTER

(75) Inventor: Yasuhide Takeda, Tokyo (JP)

(73) Assignees: Kabushiki Kaisha Sato (JP); Kabushiki Kaisha Sato Chishiki Zaisan Kenkyusyo (JP)

( * ) Notice: Subject to any disclaimer, the term of this patent is extended or adjusted under 35 U.S.C. 154(b) by 239 days.

(21) Appl. No.: 12/918,164

(22) PCT Filed: Oct. 6, 2008

(86) PCT No.: PCT/JP2008/068170

§ 371 (c)(1),
(2), (4) Date: Aug. 18, 2010

(87) PCT Pub. No.: WO2009/104300

PCT Pub. Date: Aug. 27, 2009

(65) Prior Publication Data

US 2010/0321458 A1 Dec. 23, 2010

(30) Foreign Application Priority Data

Feb. 20, 2008 (JP) ..... 2008-038698

(51) Int. Cl.
*B41J 2/335* (2006.01)

(52) U.S. Cl. ..... 347/197

(58) Field of Classification Search ..... 347/197, 347/198, 177, 218; 400/120.16, 120.17, 400/188

See application file for complete search history.

(56) References Cited

U.S. PATENT DOCUMENTS

| | | | | |
|---|---|---|---|---|
| 5,631,688 | A | 5/1997 | Hibino | 347/171 |
| 6,046,757 | A * | 4/2000 | Kanai | 347/197 |
| 6,068,415 | A | 5/2000 | Smolenski | 400/120.16 |
| 6,601,952 | B2 * | 8/2003 | Sugioka et al. | 400/188 |
| 6,975,340 | B2 * | 12/2005 | Hoshino et al. | 347/197 |
| 7,295,223 | B2 * | 11/2007 | Jung | 347/177 |

FOREIGN PATENT DOCUMENTS

| | | |
|---|---|---|
| EP | 0186207 | 7/1986 |
| JP | 6-320829 A | 11/1994 |
| JP | 10-100493 | 4/1998 |
| JP | 2003-68397 A | 3/2003 |
| JP | 2005-316282 A | 11/2005 |
| JP | 2008-30435 A | 2/2008 |

OTHER PUBLICATIONS

International Search Report dated Nov. 4, 2008, issued in corresponding international application No. PCT/JP2008/068170.

* cited by examiner

*Primary Examiner* — Kristal Feggins
(74) *Attorney, Agent, or Firm* — Ostrolenk Faber LLP

(57) ABSTRACT

A thermal printer allows ink ribbon replacement without interference of a hook positioned in the opened state particularly in an ink ribbon replacement operation.

A thermal printer includes a head lock lever 40 which includes a hook 41 at the tip of the lever. The hook is mounted such that it can be moved in the longitudinal direction relative to a turn shaft 26 during turning of the turn shaft 26, allowing the distance between the turn shaft 26 and the hook 41 to be changed. A movement control moves the head lock lever 40 such that the distance between the turn shaft 26 and the hook 41 in the opened state in which the thermal head 12 is separated from the platen roller 11 is smaller than that in the pressed state in which the thermal head 12 is pressed into contact with the platen roller 11.

10 Claims, 6 Drawing Sheets

(a)

(b)

(a)

(b)

THERMAL PRINTER

CROSS REFERENCE TO RELATED APPLICATION

The present application is a 35 U.S.C. §§371 national phase conversion of PCT/JP2008/068170 filed Oct. 6, 2008, which claims priority of Japanese Application No. 2008-038698, filed Feb. 20, 2008, the disclosure of which is incorporated by reference herein. The International Application was published in the Japanese Language.

TECHNICAL FIELD

The present invention relates to a thermal printer which performs a printing process on a print target medium with an ink ribbon stacked on the medium, by holding and conveying together the ink ribbon and the print target medium between a platen roller and a thermal head, and in particular relates to a thermal printer which allows the thermal head to be attached to and detached from the platen roller by operating a head lock lever.

BACKGROUND ART

For thermal printers which perform printing using a print target medium and an ink ribbon stacked on one another, by holding and conveying the ink ribbon and the print target medium between a platen roller and a thermal head, a known arrangement allows the thermal head to be attached to and detached from the platen roller (which allows the thermal head to be switched between an opened state and a closed state) by operating a head lock lever. (See Japanese Patent Application Laid Open No. H10 100493, for example).

Such a thermal printer has a configuration in which the thermal head is supported by a head supporting means swingably mounted to a support shaft. The head supporting means can be swung by turning a turn shaft mounting a contact member which is in contact with the head supporting means. The turn shaft can be turned by operating the head lock lever which includes a hook at its tip. In the pressed state in which the thermal head is pressed into contact with the platen roller, the hook is engaged with an engagement reception shaft provided on the platen roller side.

However, if a configuration is employed which allows the thermal head to be a significant distance from the platen roller with conventional techniques to facilitate maintenance, there is a need to move the turn shaft upward in order to ensure the swinging angle for the head supporting means. This leads to a need to set the distance between the turn shaft and the hook to a great distance. In some cases, this leads to a problem in that the ink ribbon replacement operation is inhibited by the hook located at a position in the opened state in which the thermal head is at a significant distance from the platen roller. If a ribbon supply shaft and a ribbon winding shaft are supported in a cantilever manner, the ink ribbon replacement operation is performed from the open end side of the ribbon supply shaft and the ribbon winding shaft. If the hook is located at a position which crosses the ink ribbon travel route, as viewed from the open end side in the opened state in which the ink ribbon can be replaced, the ink ribbon comes in contact with the hook in the ink ribbon replacement operation. This leads to a difficulty in the ink ribbon replacement operation. Furthermore, if the travel route for the ink ribbon is set to bypass the hook, there is a need to prepare a space for the ink ribbon travel route, leading to a larger scale of the apparatus.

SUMMARY OF INVENTION

Technical Problem

The present invention has been made in order to solve the aforementioned problem. It is an object of the present invention to provide a thermal printer in which, to facilitate the maintenance, even in a case in which a configuration is employed which allows the thermal head to be a significant distance from the platen roller, the hook located at a position in the opened state does not inhibit the ink ribbon replacement operation, thereby allowing the ink ribbon to be easily replaced.

Solution to Problem

In order to solve the aforementioned problem, the present invention employs the following configuration.

A thermal printer performs a printing process with an ink ribbon, which has been set between a ribbon supply shaft and a ribbon winding shaft supported in a cantilever manner. The ribbon is stacked on a print target medium, and then the ink ribbon and the print target medium are held and conveyed between a platen roller and a thermal head. The thermal printer includes: a head support for the thermal head. That support is swingably mounted to a support shaft. A swing control controls the swing of the head support according to the turning of a turn shaft. A head lock lever includes an engaging device at its tip along the longitudinal direction. That lever is movably mounted such that it can be moved in the longitudinal direction relative to the turn shaft while also turning the turn shaft, thereby allowing the distance between the turn shaft and the engaging device to be changed. A movement control device moves the head lock lever such that the distance between the turn shaft and the engaging device in the opened state, in which the thermal head is separated from the platen roller, is smaller than that distance in the pressed state in which the thermal head is pressed into contact with the platen roller. This extends the engaging device in the pressed state to a position at which the engaging device can be engaged with an engagement reception shaft such that it crosses the traveling route for the ink ribbon as viewed from the open end side of the ribbon supply shaft and the ribbon winding shaft. This thereby retracts the engaging device in the opened state to a position at which the engaging device does not cross the traveling route for the ink ribbon as viewed from the open end side of the ribbon supply shaft and the ribbon winding shaft.

The invention also relates to a such thermal printer, wherein the movement control means comprises: a groove wherein the distance from the turn shaft, within a movable range of the head lock lever, is reduced from the position at which the head lock lever is positioned in the pressed state towards the position at which the head lock lever is positioned in the opened state. A protrusion is provided to the head lock lever, and loosely fits to the groove.

Advantageous Effects of Invention

A thermal printer according to the present invention includes: a head support which supports a thermal head and which is swingably mounted to a support shaft; a swing control device which controls the swing of the head support according to the turn of a turn shaft; a head lock lever which includes an engaging device at the tip thereof along the longitudinal direction, and which is mounted such that it can be moved in the longitudinal direction relative to the turn shaft while turning the turn shaft, thereby allowing the distance between the turn shaft and the engaging device to be changed. A movement control moves the head lock lever such that the distance between the turn shaft and the engaging device in the opened state in which the thermal head is separated from a platen roller is smaller than that in the pressed state in which the thermal head is pressed into contact with the platen roller. The thermal printer is configured such that, in the pressed state, the engaging device is extended such that it can be engaged with an engagement reception shaft and such that it crosses the traveling route for an ink ribbon as viewed from the open end side of a cantilevered ribbon supply shaft and a cantilevered ribbon winding shaft. On the other hand, in the opened state, the engaging device is retracted to a position at which the engaging device does not cross the traveling route for the ink ribbon as viewed from the open end side of the ribbon supply shaft and the ribbon winding shaft. Thus, even when, in order to facility the maintenance, a configuration is employed in which the thermal head can be a significant distance from the platen roller, while the ribbon supply shaft and the ribbon winding shaft are supported in a cantilever manner. This allows the ink ribbon to be replaced from the open end side of the ribbon supply shaft and the ribbon winding shaft. Such an arrangement allows the engaging device in the pressed state to be engaged with the engagement reception shaft located at a position at which the engaging device cannot be engaged without crossing the traveling route for the ink ribbon. Furthermore, such an arrangement also allows the engaging device in the opened state to be retracted to a position at which it does not cross the ink ribbon. Thus, such an arrangement provides the advantage of allowing the ink ribbon to be replaced without interference of the hook positioned in the opened state, thereby facilitating the ink ribbon replacement operation.

Furthermore, with the thermal printer according to the present invention, the movement control has a configuration including: a groove portion wherein the distance from the turn shaft, within a movable range of the head lock lever, is reduced from the position at which the head lock lever is positioned in the pressed state towards the position at which the head lock lever is positioned in the opened state. A protrusion is provided to the head lock lever and loosely fit to the groove. Such an arrangement provides the advantage of allowing change of the distance between the turn shaft and the engaging device using such a simple configuration without involving any electric control.

DESCRIPTION OF EMBODIMENTS

Detailed description will be made below regarding an embodiment of the present invention with reference to the drawings.

Figure 1:
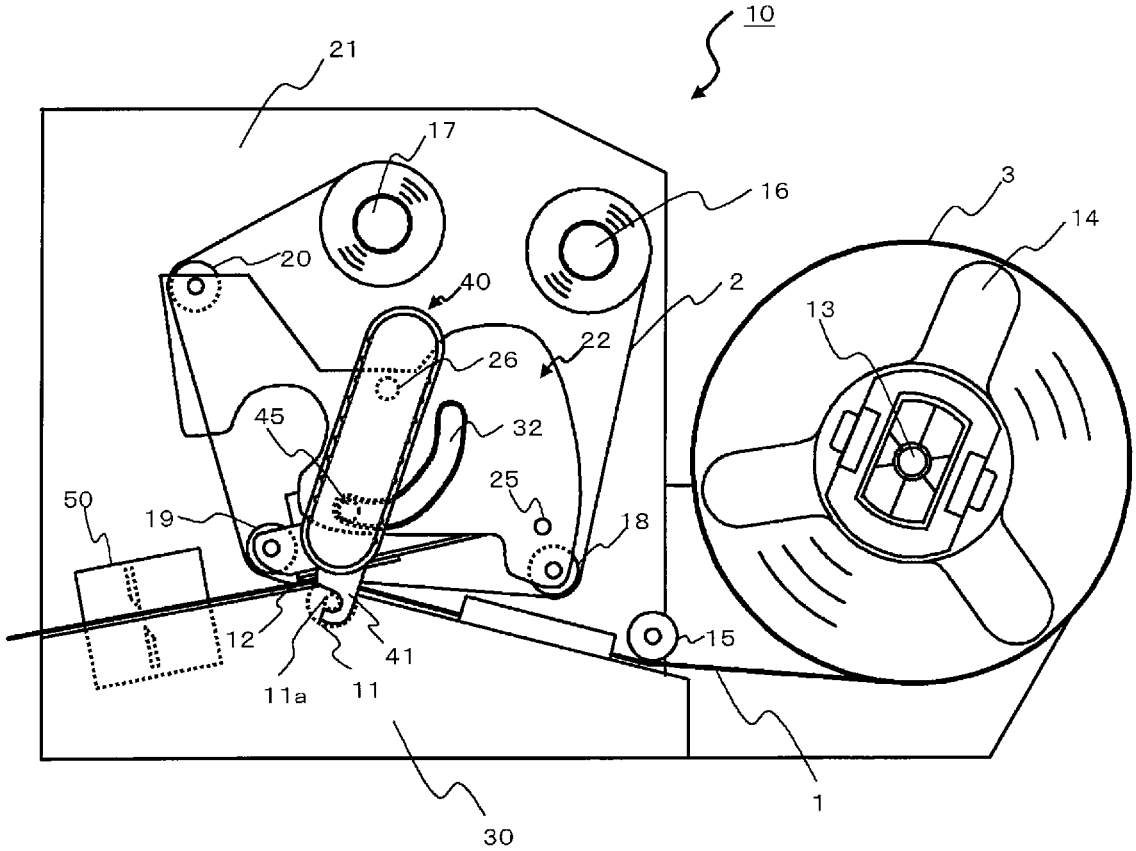
FIG. 1 is a schematic side view which shows a configuration of an embodiment of a thermal printer according to the present invention.

Referring to FIG. 1, the thermal printer 10 according to the present embodiment has a configuration including, as a printing unit, a platen roller 11 and a thermal head 12 having a face on which multiple heaters are formed and arranged such that they face the platen roller 11 along the width direction. With such a configuration, a print target medium 1, which here is a consecutive tag set formed of consecutive tags, and an ink ribbon 2 are stacked on one another and are held to be conveyed together between the platen roller 11 and the thermal head 12. Furthermore, ink is transferred from the ink ribbon 2 to the print target medium 1 by operating the heaters on the thermal head 12 to selectively generate heat, thereby performing a printing process. The print target medium 1 thus printed is cut off at a predetermined position by a cutter device 50 provided in the downstream stage of the printing unit. Following that, the print target medium 1 thus cut off is discharged.

The print target medium 1 is rotatably supported in a state in which it is wound onto a tubular member, such as a paper tube or the like, in the form of a roll, i.e., as a rolled paper sheet 3. The print target medium 1 is pulled out by holding and conveying the ink ribbon and the print target medium between the platen roller 11 and the thermal head 12. The print target medium 1 thus pulled out from a supply shaft 13 is supplied to the nip between the platen roller 11 and the thermal head 12. A roll paper sheet guide plate 14 guides the roll paper sheet 3 mounted to the supply shaft 13. A guide roller 15 guides the print target medium 1 pulled out from the supply shaft 13 to the nip between the platen roller 11 and the thermal head 12.

Furthermore, the ink ribbon 2 is set between the ribbon supply shaft 16 and the ribbon winding shaft 17. The latter is rotationally driven in association with the platen roller 11. With such an arrangement, the unused ink ribbon 2 supported by the ribbon supply shaft 16 in a state in which the ink ribbon 2 has been wound on the ribbon supply shaft 16 is in the form of a roll. The ink ribbon is supplied along with the print target medium 1 to the nip between the platen roller 11 and the thermal head 12. After ink has been transferred from it, the ink ribbon 2 is spooled onto the ribbon winding shaft 17. A guide roller 18 guides the unused ink ribbon 2 supplied by the ribbon supply shaft 16 to the nip between the platen roller 11 and the thermal head 12. Guide rollers 19 and 20 guide the ink ribbon 2 to the ribbon winding shaft 17 after ink has been transferred.

The supply shaft 13, the guide roller 15, the ribbon supply shaft 16, and the ribbon winding shaft 17 are supported by a main side plate 21 in a cantilever manner. A print unit chassis 22 supports the thermal head 12, the guide roller 18, and the guide roller 20. This chassis is also supported by the main side plate 21 in a cantilever manner.

Figure 2:
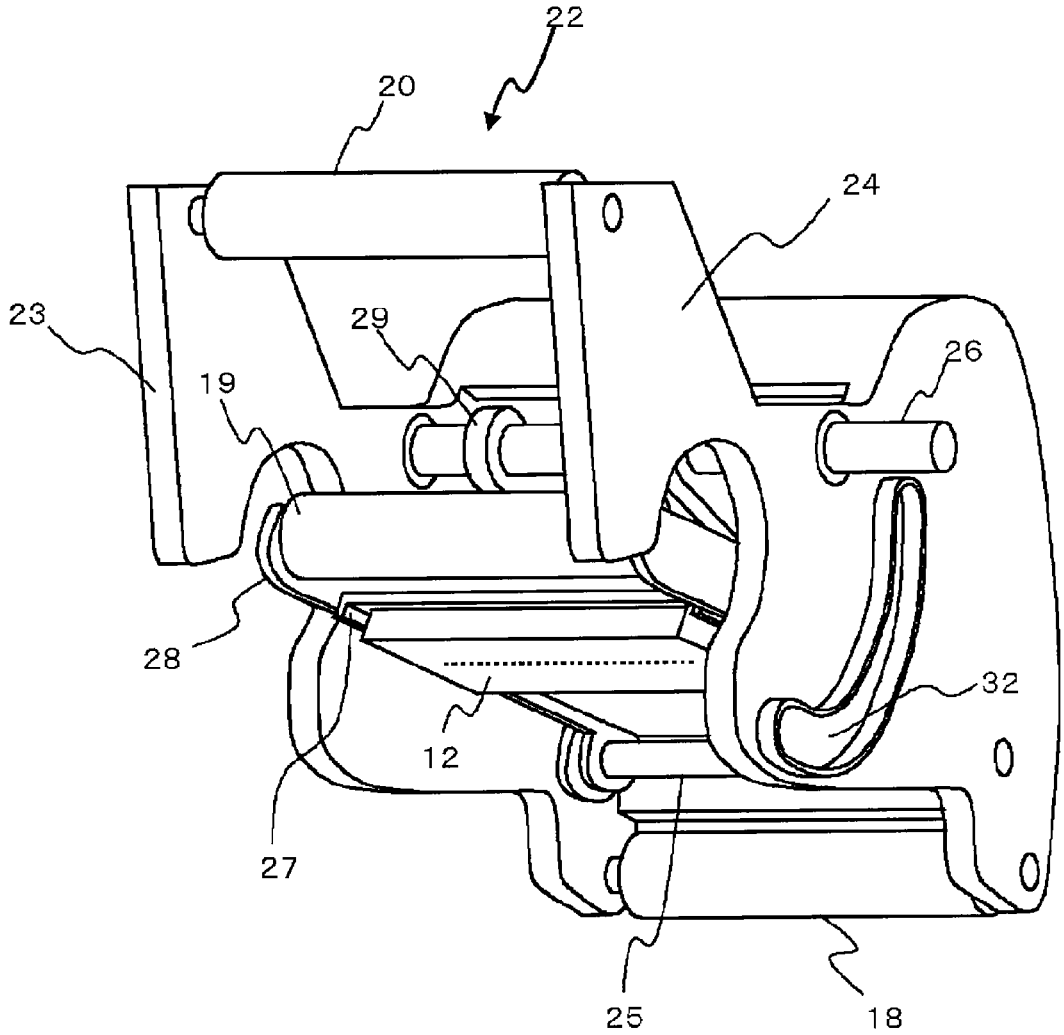
FIG. 2 is a perspective view which shows a configuration of a printing unit chassis shown in FIG. 1.

Referring to FIG. 2, the print unit chassis 22 includes a first side plate 23 and a second side plate 24, which are mounted to the main side plate 21 and are also arranged opposed to one another at a predetermined spacing interval. Between the first side plate 23 and the second side plate 24, the guide roller 18 is arranged at the perimeter, in the lower portion, on the upstream side of the conveying direction for the print target medium 1 (which will be referred to simply as the "conveying direction"). The guide roller 20 is arranged at the perimeter in the upper portion on the upstream side of the conveying direction. The support shaft 25 is arranged in the lower portion on the relatively downstream side in the conveying direction. Furthermore, a turn shaft 26 is arranged in the upper portion on the downstream side in the conveying direction relative to the support shaft 25 such that it protrudes from the second side plate 24.

Figure 3:
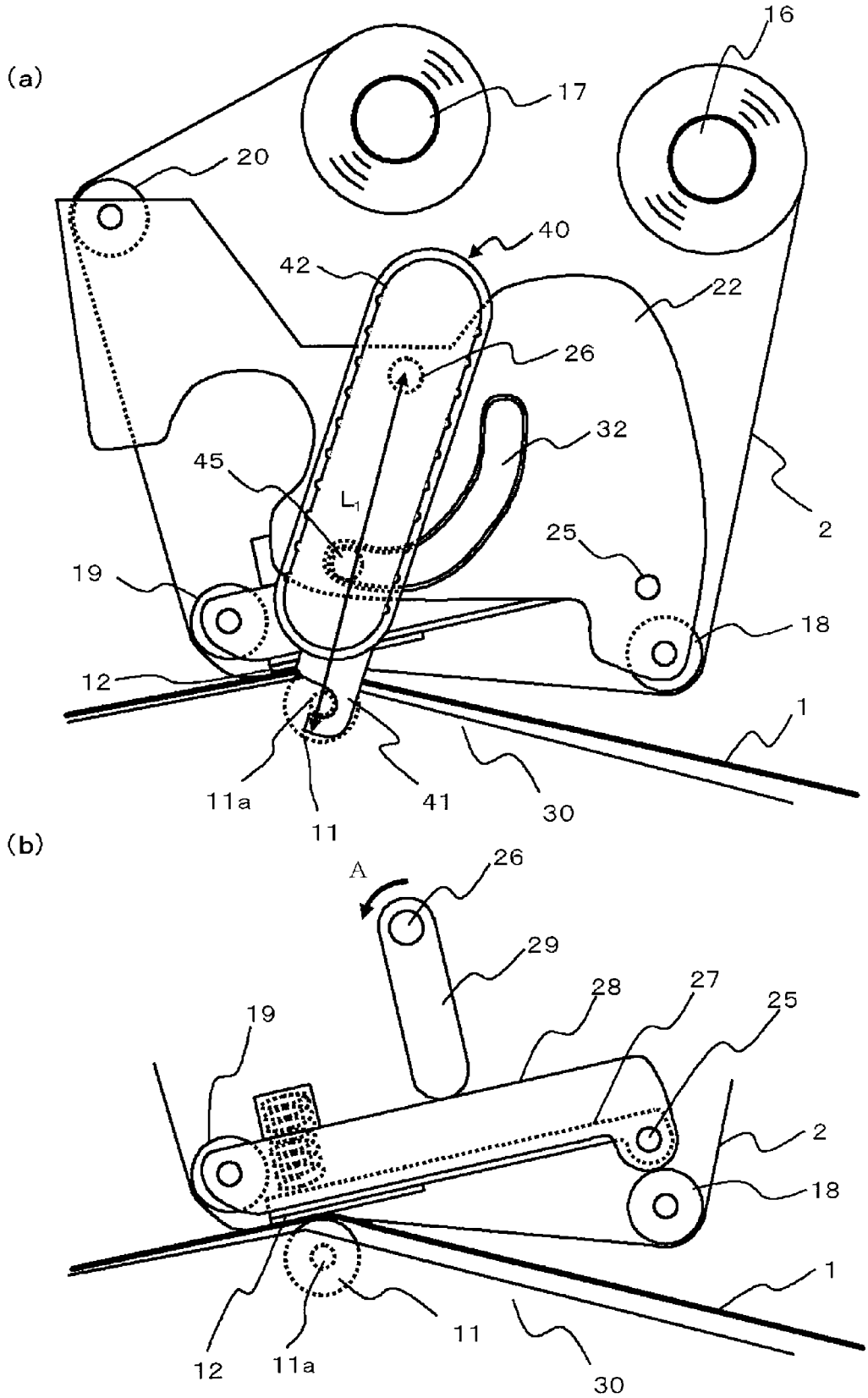
FIG. 3 is a principal side view which shows the pressed state in which a thermal head shown in FIG. 1 is pressed into contact with a platen roller.

In FIG. 3(*b*) a head support unit 27 supports the thermal head 12, and a pressing unit 28 which presses the head support unit 27, i.e., the thermal head 12, into contact with the platen roller 11 with a predetermined pressing force are swingably mounted to the support shaft 25. The guide roller 19 is mounted on the open end side of the pressing unit 28.

A contact member 29, which controls the swing of the head support unit 27 and the pressing unit 28, is mounted to the turn shaft 26. Turning the turn shaft 26 allows the state to be switched between the pressing state shown in FIG. 3, in which the thermal head 12 is pressed into contact with the platen roller 11 mounted to a bottom portion 30, and the opened state shown in FIG. 4, in which the thermal head 12 is separated from the platen roller 11 mounted to the bottom portion 30.

The turn shaft 26 can be turned using a head lock lever 40 which is mounted to the open end of the turn shaft 26 protruding from the second side plate 24. The lever 40 includes a hook 41 at the tip of the lever 40, along the longitudinal direction of the lever. FIG. 3(*a*), shows a state in which, by turning the head lock lever 40, the hook 41 engages an engagement reception shaft 11*a* arranged concentrically with the platen roller 11 mounted to the bottom portion 30 such that the lever and hook 41 cross the traveling route for the ink ribbon 2, as viewed from the open end side, as shown in FIG. 3(*b*). This sets to the pressed state in which the contact member 29 attached to the turn shaft 26 presses the pressing unit 28 downward such that the thermal head 12 is pressed into contact with the platen roller 11 mounted to the bottom portion 30. In this pressed state, the printing operation is performed. Force is applied to the head support unit 27 and the pressing unit 28 using an unshown force applying means, such as a spring, or the like, in a direction which separates the thermal head 12 from the platen roller 11, i.e., the direction in which the thermal head 12 is moved upward. However, engagement between the hook 41 and the engagement shaft 11*a* maintains the pressed state.

Figure 4:
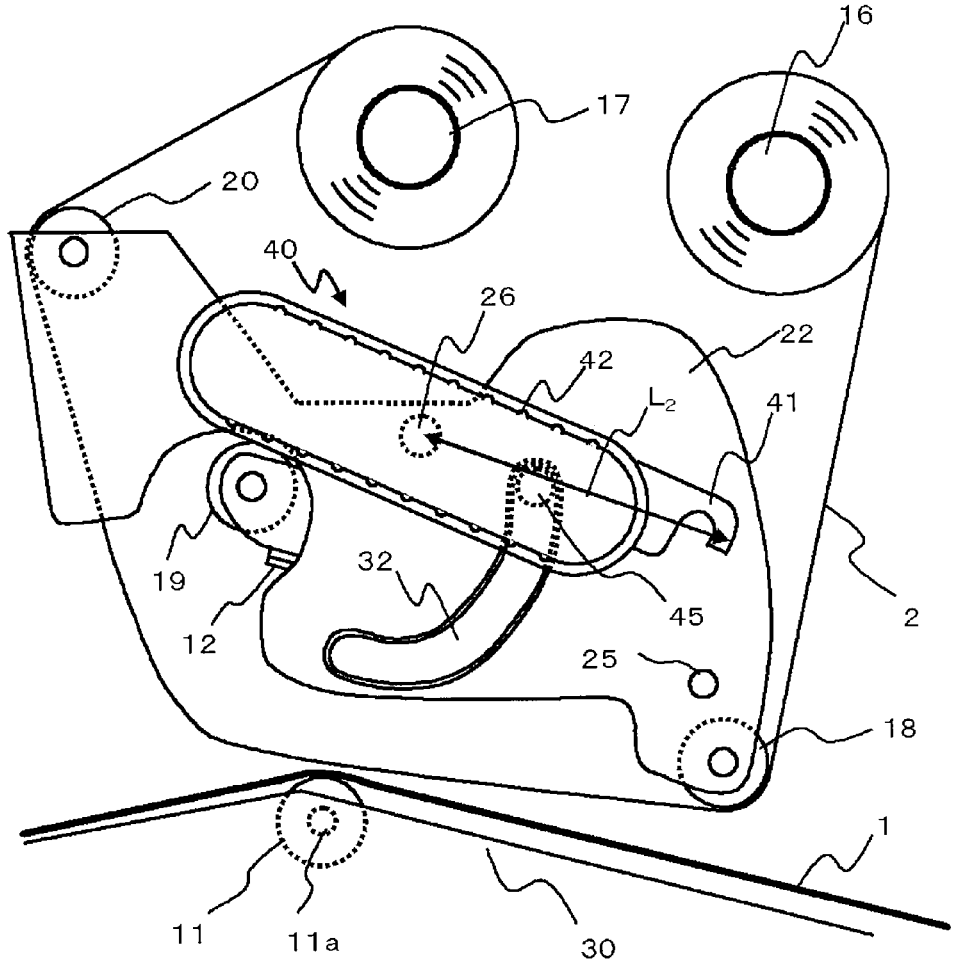
FIG. 4 is a principal side view which shows the opened state in which the thermal head shown in FIG. 1 is separated from the platen roller.
Figure 4:
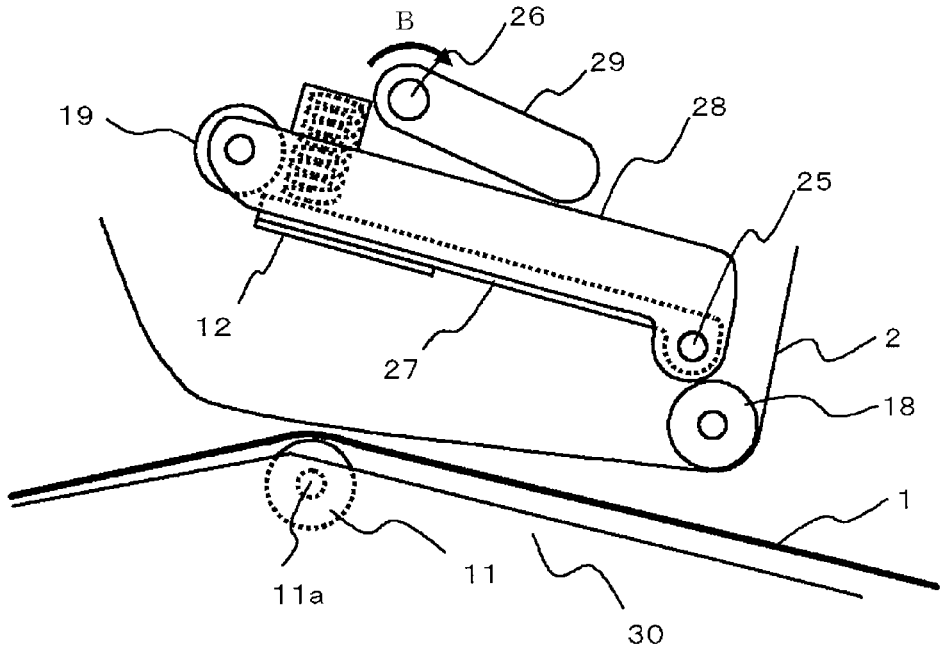

When the turn shaft 26 is turned in the direction indicated by the arrow A shown in FIG. 3(*b*) by operating the head lock lever 40, after the engagement is released between the hook 41 and the engagement reception shaft 11*a* in the pressed state, the contact member 29 is retracted upward due to the turn of the turn shaft 26. Accordingly, due to the force applied by the unshown force applying means such as a spring or the like, the head support unit 27 and the pressing unit 28 are moved upward in a direction in which they are separated from the platen roller 11. As a result, as shown in FIG. 4(*a*) and FIG. 4(*b*), the state is switched to the opened state in which the thermal head 12 is separated from the platen roller 11. In the opened state, the thermal head 12 is separated from the platen roller 11. Accordingly, an operation to replace the ink ribbon 2 may be performed, i.e., in which the ink ribbon 2 is detached from or mounted to the ribbon supply shaft 16 and the ribbon winding shaft 17. The ribbon supply shaft 16, the ribbon winding shaft 17, and the print unit chassis 22 which supports the thermal head 12, the guide roller 18, and the guide roller 20 are supported by the main side plate 21 in a cantilever manner. Accordingly, the replacement operation for the ink ribbon 20 is performed on the open end side of the ribbon supply shaft 16, the ribbon winding shaft 17, and the print unit chassis 22. Furthermore, the opened state permits maintenance operations such as cleaning of the platen roller 11 and the thermal head 12 etc., and the sheet feeding operation for the print target medium 1.

On the other hand, when the turn shaft 26 is turned in the direction indicated by the arrow B shown in FIG. 4(*b*) by operating the head lock lever 40 in the opened state, the contact member 29 is moved downward due to the turn of the turn shaft 26. Accordingly, the head support unit 27 and the pressing unit 28 are moved in the direction in which they are pressed into contact with the platen roller 11 against the force applied by the unshown force applying means such as a spring or the like. As a result, as shown in FIG. 3(*a*) and FIG. 3(*b*), the state is switched to the pressed state in which the thermal head 12 is pressed into contact with the thermal head 12.

As described above, the state can be switched between the pressed state and the opened state by operating the head lock lever 40. With the present embodiment, a configuration is employed in which the distance between the turn shaft 26 and the hook 41 provided to the head lock lever 40 is changed according to the operation of the head lock lever 40. In particular, the head lock lever 40 is moved relative to the turn shaft 26 such that the distance $L_2$ between the turn shaft 26 and the hook 41 provided to the head lock lever 40 in the opened state shown in FIG. 4(*a*) is smaller than the distance $L_1$ between the turn shaft 26 and the hook 41 provided to the head lock lever 40 in the pressed state shown in FIG. 3(*a*).

Figure 5:
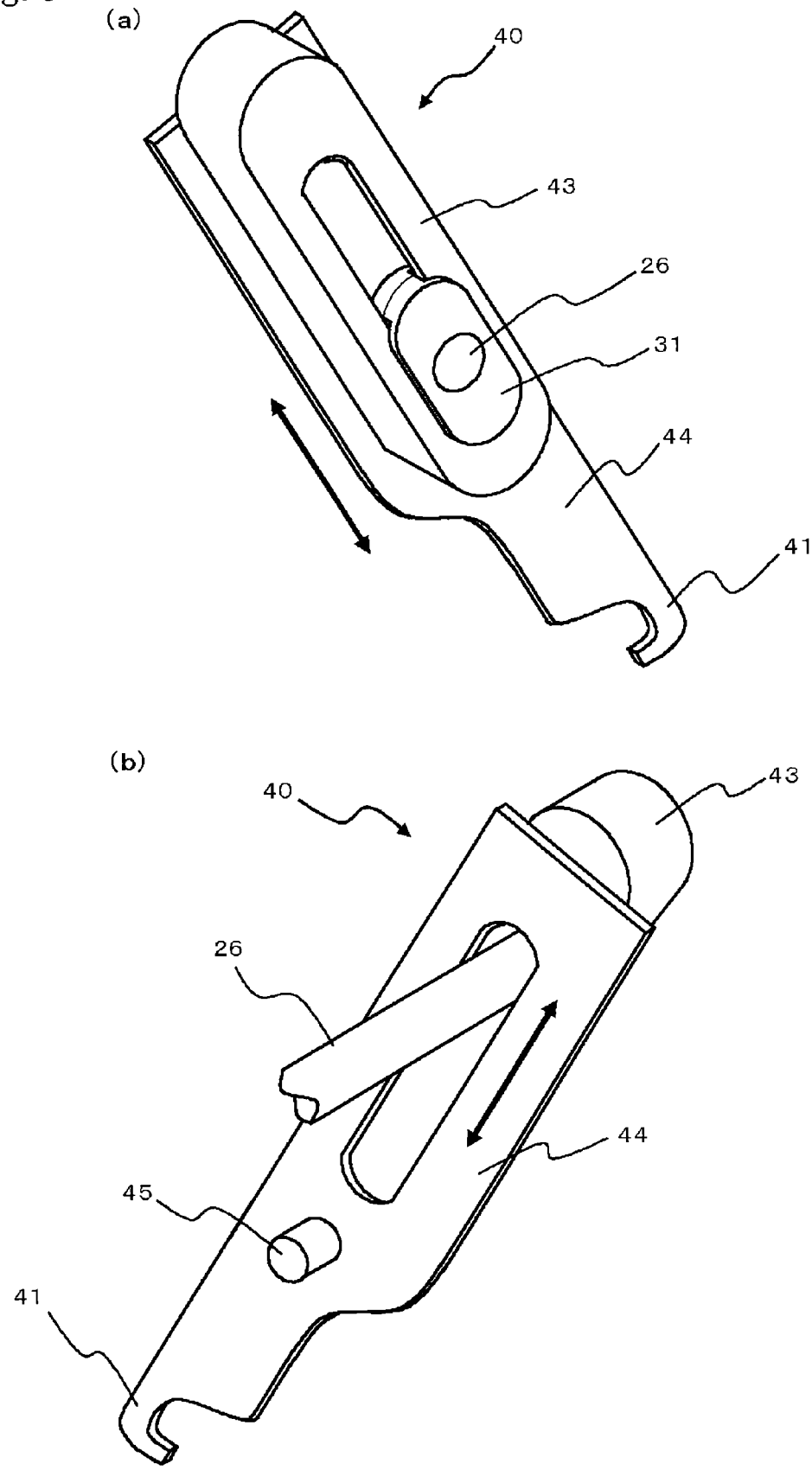
FIG. 5 is a perspective view which shows a configuration of a head lock lever shown in FIG. 1.

FIG. 5 shows the head lock lever 40 in a state when a cover 42 has been removed. The head lock lever 40 includes a slide unit 43 which is slidably mounted to a slide reception unit 31 fixed at the open end of the turn shaft 26 protruding from the second side plate 24 and includes a plate member 44 which is fixed to the slide unit 43 and which includes the hook 41 at its tip. Such an arrangement allows the slide unit 43 to slide in the longitudinal direction of the head lock lever 40. Sliding the slide unit 43 changes the distance between the turn shaft 26 and the tip at which the hook 41 is provided.

Referring to FIG. 2, a groove 32 is formed in the stationary second side plate 24 of the print unit chassis 22 such that the distance from the turn shaft 26 is reduced according to the movement of the head lock lever 40 in the movable range from the elongate position at which the head lock lever 40 is positioned in the pressed state to the contracted position at which the head lock lever 40 is positioned in the opened state. Furthermore, a protrusion 45 on the plate member 44 of the lever 40 is loosely fit to the groove 32 formed in the second side plate 24. A combination of the groove 32 and the protrusion 45 functions as a movement control allowing the head lock lever 40 to be moved in its longitudinal direction.

Figure 6:
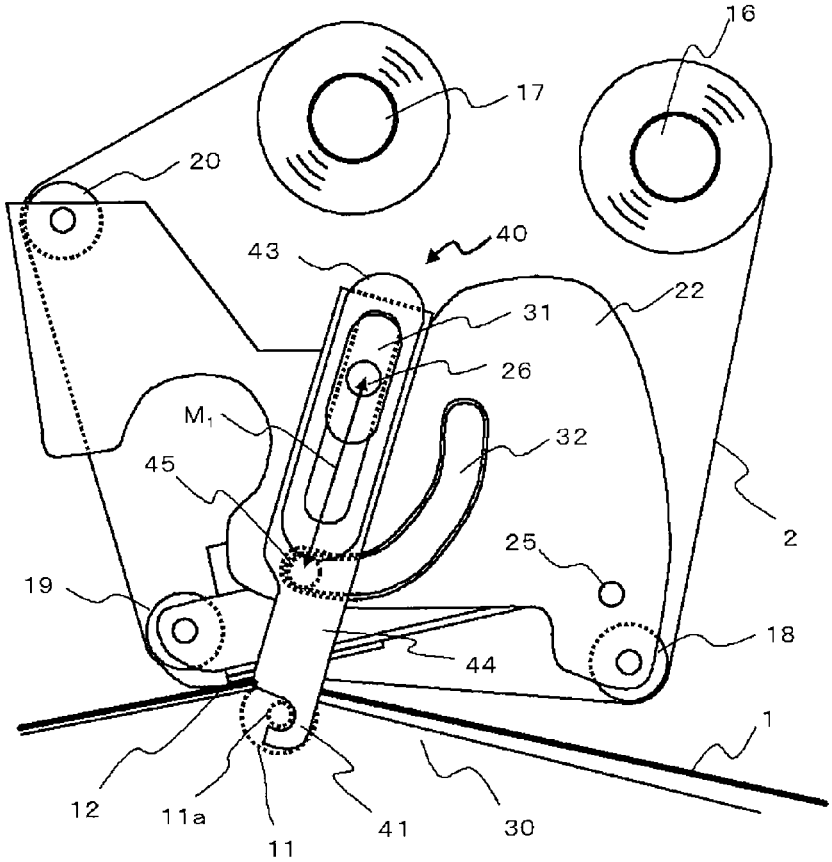
FIG. 6 is an explanatory diagram which shows the movement operation of the head lock lever shown in FIG. 1.
Figure 6:
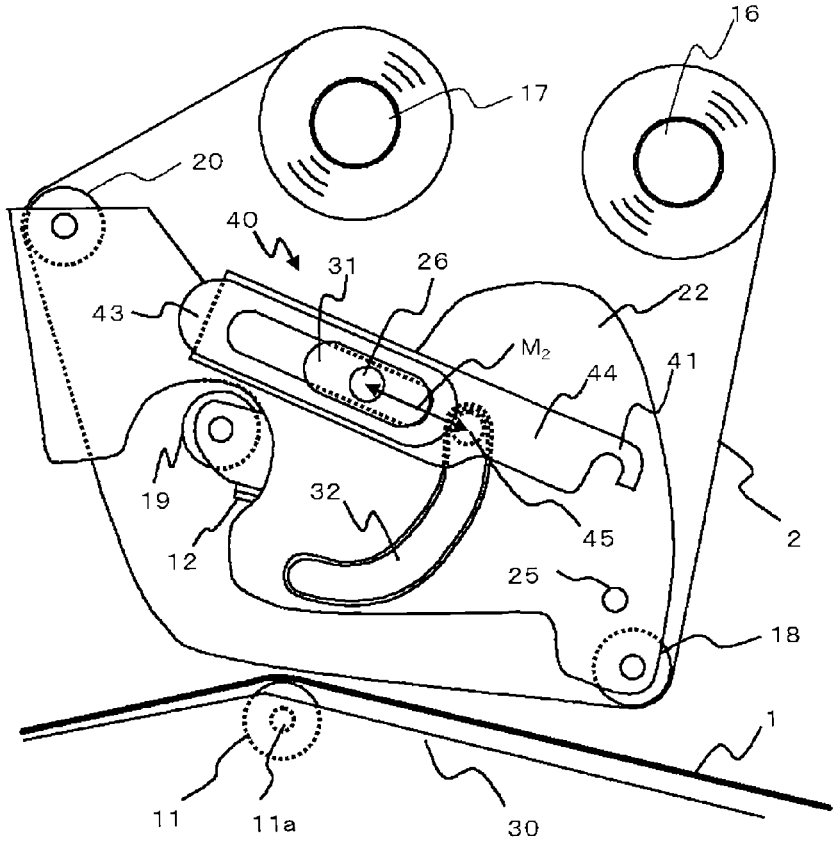

Referring to FIG. 6, the protrusion 45 is guided along the groove 32 according to the operation of the head lock lever 40, thereby changing the distance between the turn shaft 26 and the protrusion portion 45. Therefore, the distance $M_2$ between the turn shaft 26 and the protrusion 45 in the opened state shown in FIG. 6(*b*) is smaller than the distance $M_1$ between the turn shaft 26 and the protrusion 45 in the pressed state shown in FIG. 6(*a*). Accordingly, the head lock lever 40 is expanded or contracted relative to the turn shaft 26 such that the distance between the hook 41 which is moved in the form of a single unit with the protrusion 45 and the turn shaft 26 in the opened state is smaller than the distance therebetween in the pressed state. With such an arrangement, in the pressed state, the hook 41 is extended such that it can be engaged with the engagement reception shaft 11*a* arranged concentrically with the platen roller 11, i.e., positioned on the lower side relative to the traveling route for the ink ribbon 2, crossing the traveling route for the ink ribbon 2 as viewed from the open end side. Furthermore, in the opened state, the distance between the turn shaft 26 and the hook 41 is reduced, so that the hook 41 is moved to a position at which the hook 41 does not cross the traveling route for the ink ribbon 2 as viewed from the open end side. Such an arrangement allows the ink ribbon 2 to be replaced without interference from the head lock lever 40. It should be noted that, if the position of the turn shaft 26 is shifted downward, the distance between the turn shaft 26 and the hook 41 can be reduced. Accordingly, even in the opened state, such an arrangement prevents the hook 41 from crossing the traveling route for the ink ribbon 2 as viewed from the open end side. However, the position of the turn shaft 26 thus shifted downward cannot ensure a sufficient swinging angle for the head support unit 27 and the pressing unit 28. This leads to difficulty in the maintenance operation for the platen roller 11 and the thermal head 12.

The present embodiment is configured such that, in the pressed state, the lever 40 is extended such that the hook 41 can be engaged with the engagement reception shaft 11*a* and such that the lever and the hook cross the traveling route for the ink ribbon 2, as viewed from the open end side of the ribbon supply shaft 16 and the ribbon winding shaft 17. On the other hand, in the opened state, the hook 41 is retracted to a position at which the hook 41 does not cross the traveling route for the ink ribbon 2, as viewed from the open end side of the ribbon supply shaft 16 and the ribbon winding shaft 17. Thus, even in a case in which, in order to facilitate the maintenance, a configuration is employed in which the thermal head 12 can be significantly distanced from the platen roller 11, and the ribbon supply shaft 16 and the ribbon winding shaft 17 are supported in a cantilever manner, which allows the ink ribbon 2 to be replaced from the open end side of the ribbon supply shaft 16 and the ribbon winding shaft 17, such an arrangement allows the hook 41 in the pressed state to be engaged with the engagement reception shaft 11*a* located at a position at which it cannot be engaged without crossing the traveling route for the ink ribbon 2. Furthermore, such an arrangement also allows the hook 41 in the opened state to be retracted to a position at which it does not cross the ink ribbon 2. Thus, such an arrangement provides the advantage of allowing the ink ribbon to be replaced without interference of the hook then positioned in the opened state, thereby facilitating the ink ribbon replacement operation.

Furthermore, with the present embodiment, the movement control has a configuration that provides the advantage of allowing the distance between the turn shaft 26 and the hook 41 which is an engagement device using such a simple configuration without involving any electric control operation.

It should be noted that the present invention is not restricted to the above-described embodiments. It can be clearly understood that each of the embodiments may be modified as appropriate without departing from the technical scope of the present invention. Furthermore, the number, the positions, the configurations, etc., of the aforementioned components are not restricted to those in the above-described embodiments. Rather, the number, positions, configurations, thereof can be modified as suitable for carrying out the present invention. It should be noted that, in the drawings, the same components are denoted by the same reference numerals.

The invention claimed is:

1. A printer which performs printing with an ink ribbon on a print target medium stacked with the ink ribbon, the printer including:

a device configured for holding and conveying the ink ribbon and the print target medium between a platen and a print head, a support shaft, a print head support which supports the print head to the support shaft to which the print head support is swingably mounted;

a turn shaft, a swing control configured to control the swing of the head support according to the turn of the turn shaft;

a print head lock lever which includes an engaging device at a tip of the lock lever along the longitudinal direction of the lever, the engaging device is movably mounted such that it can be moved in the longitudinal direction of the lever relative to the turn shaft during turning of the turn shaft for allowing a distance between the turn shaft and the engaging device to be changed; and a movement control configured to move the head lock lever such that the distance between the turn shaft and the engaging device in an opened state in which the thermal head is separated from the platen roller is smaller than that in a pressed state in which the thermal head is pressed into contact with the platen, thereby extending the engaging device in the pressed state to a position at which the engaging device can be engaged with an engagement reception element such that the engaging device crosses the traveling route for the ink ribbon and thereby retracting the lever and the engaging device in the opened state to a position at which the engaging device does not cross the traveling route for the ink ribbon.

2. A thermal printer according to claim 1, wherein the movement control comprises:

a groove in the printer; a protrusion on the head lock lever and loosely fit to the groove;

wherein the distance from the turn shaft, within a movable range of the head lock lever, is reduced from the position at which the head lock lever is positioned in the pressed state towards the position at which the head lock lever is positioned in the opened state.

3. A thermal printer according to claim 1, further comprising an ink ribbon supply shaft before the ink ribbon passes the platen and a winding up shaft for the ink ribbon after the ink ribbon passes the platen.

4. A thermal printer according to claim 3, wherein the ink supply shaft and winding up shaft are supported at an end thereof in a consistent manner.

5. A thermal printer according to claim 4, wherein the ink supply shaft and the winding up shaft are supported in a cantilever manner by the printer.

6. A thermal printer according to claim 5, wherein the engaging device crosses the traveling route for the ink ribbon as viewed from an open end side of the ribbon supply shaft and the ribbon winding shaft.

7. A thermal printer according to claim 1, wherein the print head is a thermal head, and the ink ribbon prints as it is heated by the thermal head.

8. A thermal printer according to claim 1, wherein the platen is a platen roller.

9. A thermal printer according to claim 1, wherein the engagement reception element comprises a shaft.

10. A thermal printer according to claim 9, wherein the engaging device comprises a hook on the lock lever to engage the reception element shaft.

* * * * *